US006131418A

United States Patent [19]

Matsuda et al.

[11] Patent Number: 6,131,418

[45] Date of Patent: Oct. 17, 2000

[54] NEEDLE BED FOR KNITTING MACHINE

[76] Inventors: Yasuhiko Matsuda, 717-16, Tabata, Toyama-shi, Toyama-ken; Michio Ito, 2-25, Kamogawa-machi, Uozu-shi, Toyama-ken, both of Japan

[21] Appl. No.: 09/431,471

[22] Filed: Nov. 1, 1999

[30] Foreign Application Priority Data

Nov. 16, 1998 [JP] Japan ..... 10-325196

[51] Int. Cl.[7] ..... D04B 15/10

[52] U.S. Cl. ..... 66/115

[58] Field of Search ..... 66/114, 115, 60 R, 66/64

[56] References Cited

U.S. PATENT DOCUMENTS 2,106,919 2/1938 Robaczynski ..... 66/115

2,748,581 6/1956 Luchsinger ..... 66/115

4,649,721 3/1987 Goller et al. ..... 66/115

*Primary Examiner*—Danny Worrell

[57] ABSTRACT

A metallic needle bed having a multiplicity of needle sliding grooves which are formed in parallel so as to slidably support a knitting needle on a surface thereof. Two or more short needle plates are removably fixed in a successively detachable/attachable manner, on an upper surface of metallic reinforcing support member which has a length substantially equal to a desired needle bed length. The short needle plates are formed with a plurality of the needle sliding grooves on a surface thereof, obtain a desired needle bed dimension when connecting these needle plates in a longitudinal direction, and are formed with a taper surface having a thickness gradually decreasing toward an edge portion at a rear surface on a side where a knitted loop forming portion of the knitting needle is projected/retracted.

4 Claims, 4 Drawing Sheets

FIG. IC
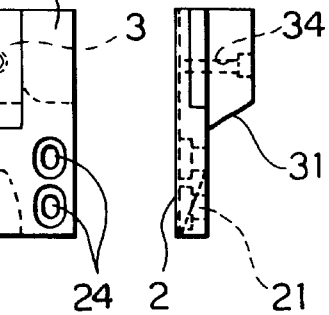
FIG. IA
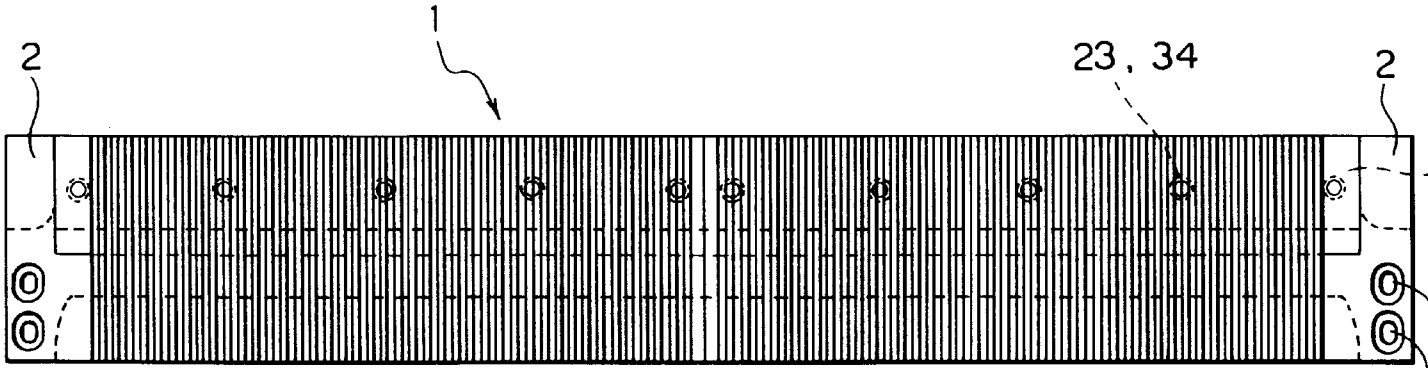
FIG. IB
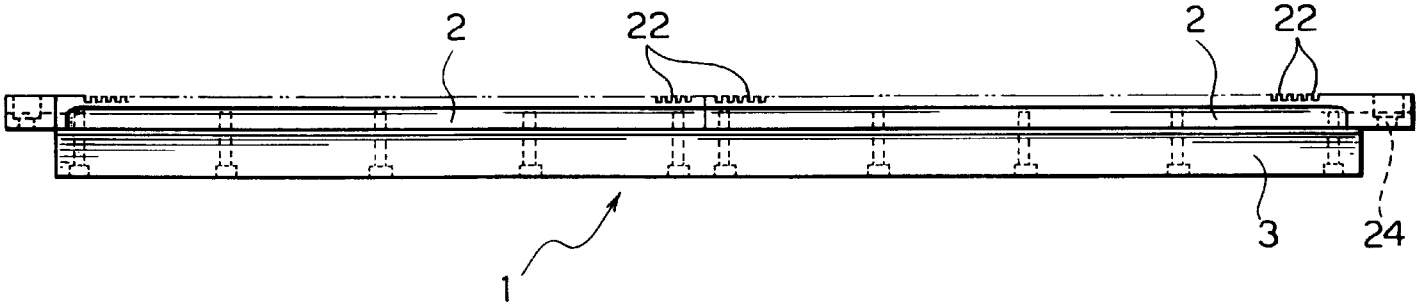

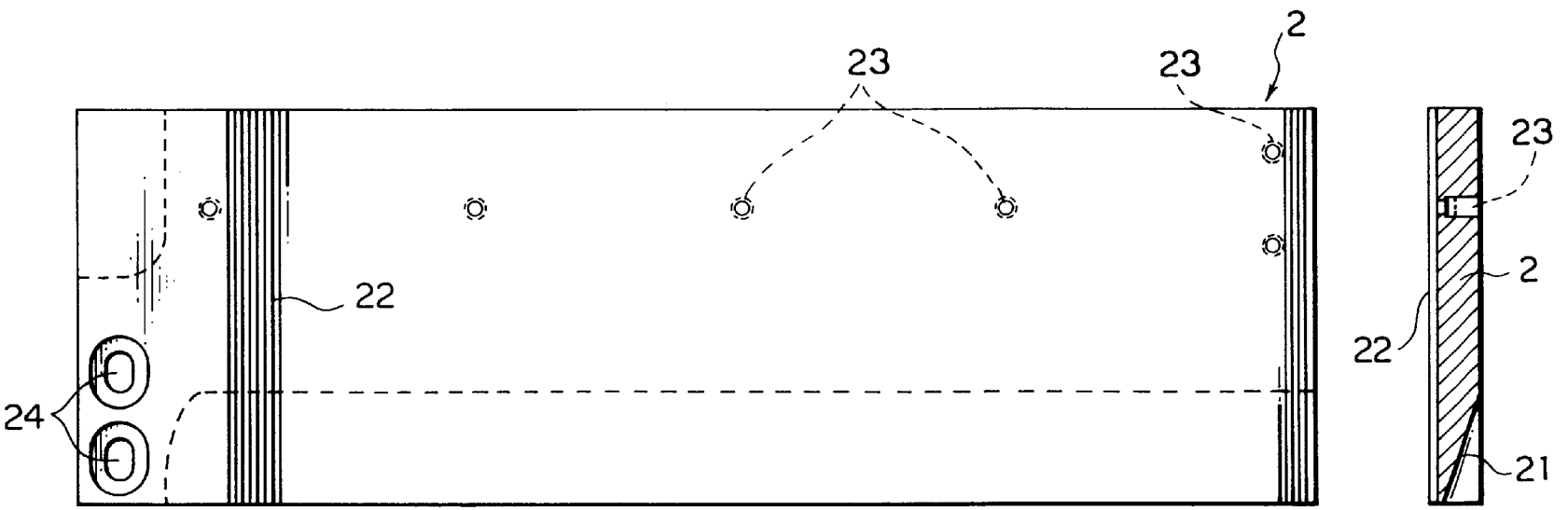
FIG. 2A
FIG. 2C
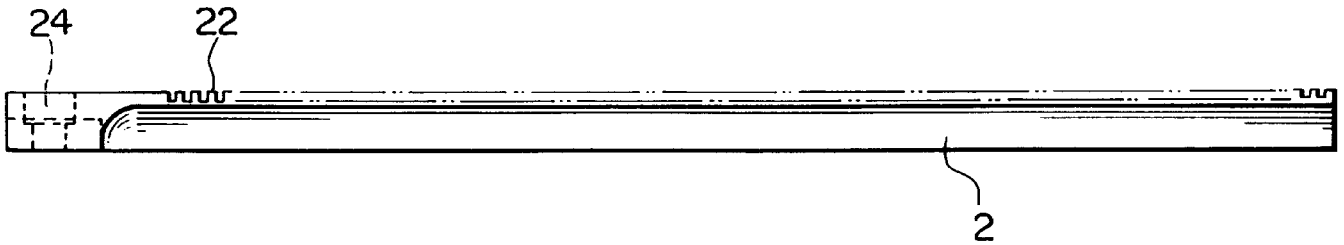
FIG. 2B

NEEDLE BED FOR KNITTING MACHINE

BACKGROUND OF THE INVENTION

1. Field of the Invention

The present invention relates to a needle bed for various knitting machines, and more particularly, to a needle bed for a knitting machine, which is excellent in a workability, stiffness and wear resistance.

2. Description of the Related Art

A conventional needle bed, which is applied to a narrow width crochet knitting machine in particular, comprises a single metallic plate material horizontally placed on a base of a knitting machine, and surface of the metallic plate material is formed with a great many of needle sliding grooves except opposite ends of the plate in a longitudinal direction, as disclosed in Japanese Patent Publication No. 4-44025. This groove forming is an extremely fine machining, and requires a high machining accuracy. In general, the aforesaid groove forming is carried out in a manner that a groove is formed by means of a dedicated milling machine, and thereafter, is subjected to lapping.

A rear surface of the plate material is formed with a taper surface which gradually decreases in thickness toward an edge portion on a side where a knitted loop forming portion of a knitting needle is projected/retracted. In knitting a yarn, this taper surface serves to avoid an interference with a warp, a weft, peripheral movable members or the like, and as a result, a good knitted loop is formed. In general, SCM44F, which is a casting alloy of Cr and Mo, is used as a component of the conventional needle bed, and is not subjected to special quench hardening, and further, the SCM44F has an HR hardness of about 25.

However, in the case where the raw material of the needle bed is the long and single metallic plate material having a high hardness, when forming the aforesaid taper surface in the plate material and forming fine grooves requiring a high machining accuracy in to the plate material, a "twist" or "strain" is easy to be generated in the plate material, i.e. needle bed. For this reason, a material selection, machining procedures, control, product management and the like are troublesome.

On the other hand, a portion to which the greatest load is applied when forming a knitted loop by the knitting needle, is a groove end portion on the side where the above taper surface of the needle bed is formed; for this reason, the above portion most badly wears off. In order to prevent the above portion from wearing, a material having a high hardness and a high wear resistance must be selected. However, the higher the required hardness becomes, the higher the brittleness becomes; for this reason, it is difficult to subject the raw material to machining, and a material cost becomes high in addition to a machining cost. Further, the needle bed must be replaced with a new needle bed due to a local wear; for this reason, there is a problem on durability.

SUMMARY OF THE INVENTION

The present invention has been made in order to solve the aforesaid problem in the prior art. It is, therefore, an object of the present invention to provide a needle bed for a knitting machine, which can be machined with a high accuracy, has a high hardness and a high wear resistance, and is excellent in durability and economical point of view.

The above object is effectively achieved by the invention described below.

The invention provides a metallic needle bed for a knitting machine, having a great many of needle sliding grooves which are formed in parallel so as to slidably support a knitting needle on a surface thereof. The needle bed comprises two or more short needle plates which are formed with a plurality of the needle sliding grooves on a surface thereof, obtain a desired needle bed dimension when connecting these needle plates in a longitudinal direction, and are formed with a taper surface having a thickness gradually decreasing toward an edge portion at a rear surface on a side where a knitted loop forming portion of the knitting needle is projected/retracted; and a metallic reinforcing support member which has a length substantially equal to a desired needle bed length, and is fixed on non-taper surface portions on rear surfaces of the short needle plate where no taper surface is formed, wherein the non-taper surface portion on the rear surfaces of the respective short needle plates being abutted against a surface of the reinforcing support member so that the short needle plates are removably fixed thereon in a longitudinal direction in a successively detachable/attachable manner.

Since the sliding groove forming portion of the knitting needle which is easy to receive an influence of a tension of a knitting yarn at the time of knitting is divided into plural short needle plates having needle sliding grooves, the short needle plate can be manufactured of a metallic plate material having the necessary minimum thickness. As a result, it is possible to subject the needle plate to machining so as to form fine grooves therein with a high accuracy, and further, to subject the needle plate to hardening so as to obtain a desired hardness, after being subjected to machining. The plural short needle plates thus manufactured are successively fixed onto the single reinforcing support member which is made of a metallic material having a high stiffness. Thus, the obtained needle bed has a desired hardness and stiffness, and is subjected to machining with a high accuracy. Further, each short needle plate is fixed onto the reinforcing support member so as to be removable. Therefore, for example, in the case where the needle plate locally wears, there is no need of replacing the whole of the needle bed, and it is possible to replace only worn short needle plate with a new one.

Preferably, the surface of the reinforcing support member is formed with a plurality of fitting grooves for fitting the short needle plate therein, and the short needle plate is fixed into the fitting grooves in a successively detachable/attachable manner. With the above construction, the needle plate member is fixed onto the fitting groove of only portions required for forming a knitted loop, and it is possible to remove the needle plate member of a portion not in operation from the fitting grooves. This serves to avoid an unnecessary knitting by the knitting needle, and to frequently replace the needle plate member.

Further preferably, in order to secure an easiness of groove forming, the short needle plate is made of a metallic material having little brittleness, and a casting aluminum alloy is defined as the preferable material. On the other hand, the reinforcing support member is made of a metallic material having a high stiffness, and an alloy tool steel having a high wear resistance is defined as the preferable material.

Still preferably, the short needle plate is subjected to hardening on at least edge surface on a side where a knitted loop forming portion of the knitting needle is projected/retracted. Whereby it is possible to obtain a desired hardness, and to further improve a hardness of a portion which most badly wears.

BRIEF DESCRIPTION OF THE DRAWINGS

FIGS. 1A, 1B and 1C show a structure of a needle bed according to a first embodiment of the present invention.

FIGS. 2A, 2B and 2C show a structure of a left side short needle plate which is one of components of the needle bed of FIG. 1A–1C.

DETAILED DESCRIPTION OF THE PREFERRED EMBODIMENTS

Preferred embodiments of the present invention will be described below with reference to the accompanying drawings.

Figure 3B:
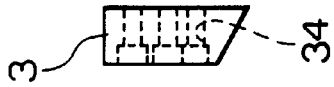
FIGS. 3A and 3B show a structure of a reinforcing support member which is another component of the needle bed.
Figure 3A:
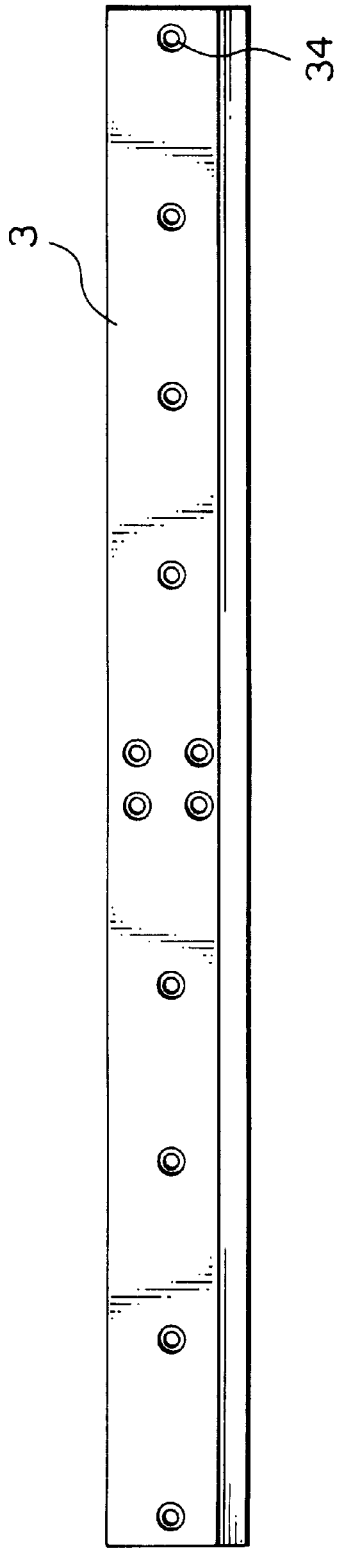

FIGS. 1A to 1C are views to explain the whole structure of a needle bed for a narrow width crochet knitting machine to which the present invention is applied. FIG. 2A to 2C are enlarged views to explain a structure of a short needle plate which is one of components of the needle bed. FIGS. 3A and 3B are enlarged views to explain a structure of a reinforcing support member which is one of components of the needle bed. In this embodiment, a needle plate portion of the needle bed is, as a whole, divided into two portions. An illustrated short needle plate 2 shows a left half portion of right and left portions, and the right half portion thereof is omitted in illustration because of symmetry. In the description, "lengths" and "longitudinal" indicate the direction along the longer side of the needle bed, and "width" indicates the shorter side of the needle bed.

As seen from these figures, a needle bed 1 according to the present invention includes a plurality of metallic short needle plates 2 and a metallic reinforcing support member 3. Preferably, the short needle plate 2 has a high hardness, and in this embodiment, a casting aluminum alloy having an HR hardness of 40 to 50 is used as the short needle plate. On the other hand, it is preferable that the reinforcing support member 3 has a high stiffness, and in this embodiment, an SKD11, which is an alloy tool steel, is used. The short needle plate 2 is subjected to machining, and thereafter, its surface is subjected to nitriding so as to obtain a desired hardness.

As seen from FIGS. 1A to 1C and FIGS. 2A to 2C, the short needle plate 2 is constructed in the following manner. More specifically, the needle plate 2 comprises a short plate material having a substantially ½ length of the entire length of the needle bed 1, and an upper surface of the plate material is formed with grooves; on the other hand, a lower surface thereof is subjected to a thickness decreasing process, and thereafter, the groove portion is subjected to polishing. Thus, the short needle plate having the structure as illustrated is obtained. Thereafter, the surface of the short needle plate 2 is subjected to nitriding.

As seen from FIGS. 1A to 1C and FIGS. 2A to 2C, a raw material of the short needle plate 2 is a cast product which comprises a rectangular plate material having a length of 279 mm and a width of 89 mm. In the plate material, a taper surface 21 is formed on a surface along an edge portion on a side where a knitted loop forming portion of the knitting needle is projected/retracted, except a left end portion (or right end portion) in a longitudinal direction of the lower surface of the plate material. The taper surface 21 is formed over a range of ⅓ of the width from the lower side of FIG. 1A, and has a thickness gradually decreasing in the width direction. This taper surface 21 serves to absorb a load by a knitting yarn tension acted on the knitting needle (not shown) in knitting, and to prevent an interference with various knitting yarns and a knitting yarn guide in knitting.

The upper surface (see FIG. 1A) of the casting product according to the embodiment is formed with a great many of needle sliding grooves 22 which extend in a width direction and in parallel each other along a longitudinal direction. These needle sliding grooves 22 are subjected to machining by means of a dedicated milling machine. Moreover, the rear surface of the needle plate 2 is formed with screw holes 23 as a blank hole at a predetermined position. Further, a left end portion (or right end portion) of the needle plate 2 is formed with slots 24 for fixing one end portion of the needle plate 2 on a strut portion (not shown) standing on the machine base. The needle plate 2 is subjected to the aforesaid machining, and thereafter, the surface of the needle plate 2 is subjected to nitriding so as to obtain a desired hardness.

On the other hand, the reinforcing support member 3 which fixedly supports the short needle plate 2, comprises a single plate material which has a length shorter than the needle bed 1, and whose front edge is formed into a taper surface 31, as seen from the FIGS. 1A to 1C and FIGS. 3A and 3B. The above plate material has a width of substantially ½ of the width of the short needle plate 2, and is formed with a screw insertion hole 34 at a position corresponding to the screw hole 23 formed in the short needle plate 2.

In this embodiment, the left-side short needle plate 2 and a right-side short needle plate (not shown) having a symmetrical structure are manufactured, and then, the pair of right and left short needles plates 2 are fixed integrally with the reinforcing support member 3 by means of screws (not shown).

With the needle bed 1 of this embodiment having the aforesaid construction, the right- and left-side short needle plates 2 and one reinforcing support member 3, especially the needle plate 2 is subjected to machining, it is possible to select a metal which has a low brittleness and is readily subjected to cutting. Further, the selected plate material is very easy to be subjected to machining as compared with a long plate material, and thereafter, it is easy to obtain a desired hardness by hardening. Furthermore, in addition to a machining accuracy, it is possible to make the needle plate 2 having the needle sliding groove 22 sufficiently thin, and to economically manufacture the needle plate 2 at a low cost. In addition, so long as the reinforcing support member 3 has a desired stiffness, a price range of raw material can be widely set without requiring a special material.

Figure 4:
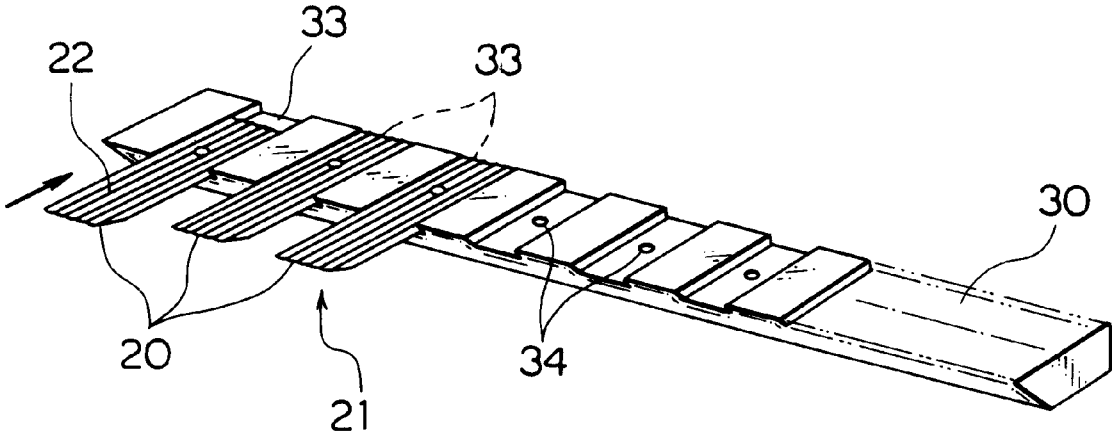
FIG. 4 is a view showing a structure of a needle bed according to a second embodiment of the present invention.

FIG. 4 shows a needle bed according to a second embodiment of the present invention. This embodiment is preferable to the case there is a needle bed portion where no knitting needle is used in knitting, such as lace knitting. The short needle plate 2 has a length shorter than its width, and many needle plate members 20 are manufactured. In order to obtain a needle bed having desired length, these needle plate members 20 are successively fixed integrally with a reinforcing support member 30 which will be described later, at a desired interval. Each needle plate member 20 is formed with the same screw hole 23 as the aforesaid screw hole 23 at a central position of ¼ from the rear end thereof. Each needle plate member 20 is also subjected to hardening as after-treatment.

On the other hand, the reinforcing support member 30 has the same length and width as those described in the above embodiment, and its needle plate member fixing surface is formed with a plurality of fitting grooves 33 for fitting the needle plate member 20 therein along a longitudinal direction at a predetermined pitch. Each fitting groove 33 is formed with a screw insertion hole 34 at the central portion thereof.

In this embodiment, the needle bed 1 is assembled in the following manner that the needle plate members 20 are fitted into the plurality of fitting grooves 33 formed on the reinforcing support member 30, and then, each needle plate member 20 is fixed integrally with the reinforcing support member 30 by means of a screw.

As is apparent from the above description, according to a structure of the present invention, the needle bed 1 has the needle plate portion where the knitting needle is slidable and the needle sliding groove to which the greatest load is applied by a tension of knitting yarn, is formed. The needle plate portion comprises the short plate materials having the necessary minimum thickness, and is divided into plural needle plates, and then, divided each of the short needle plates 2, 20 are supported and fixed onto the sheet-like reinforcing support members 3, 30 having a high stiffness. Thus, it is possible to form grooves in each of the needle plate 2, 20 with a high accuracy, and to secure a desired hardness because of readily carrying out a hardening surface treatment, and further, to replace only needle plate portion which badly worn, with another needle plate.

the above embodiment are merely recited as one example of the present invention, and is obvious to a person skilled in the art to make various modifications within a scope of the present invention.

What is claimed is:

1. A metallic needle bed for a knitting machine, comprising:

at least two short needle plates, each short needle plate having a front side having a plurality of needle sliding grooves and an opposite rear side having a tapered surface decreasing toward an edge portion; and a metallic reinforcing support member, a plurality of the at least two short needle plates removably mounted on their rear sides to the reinforcing support member.

2. A needle bed according to claim 1, wherein the reinforcing support member has a plurality of fitting grooves and each short needle plate is removably mounted to the reinforcing support member in one of the fitting grooves.

3. A needle bed according to claim 1 or 2, wherein each of the short needle plates is made of a casting aluminum alloy, and the reinforcing support member is made of a metallic material having a stiffness greater than a stiffness of the short needle plates.

4. A needle bed according to claim 3, wherein each of the short needle plates is subjected to hardening on at least a portion of the edge portion.

* * * * *

UNITED STATES PATENT AND TRADEMARK OFFICE

CERTIFICATE OF CORRECTION

PATENT NO. : 6,131,418
DATED : October 17, 2000
INVENTOR(S) : Yasuhiko Matsuda et al.

It is certified that error appears in the above-identified patent and that said Letters Patent is hereby corrected as shown below:

Title page,
Column 1, delete item [76] in its entirety and substitute therefor:
-- [75] Inventors: Yasuhiko Matsuda; Michio Ito, both of Toyama, Japan
[73] Assignee: YKK Corporation, Tokyo, Japan --.

Signed and Sealed this

Sixth Day of November, 2001

*Attest:*

Nicholas P. Godici

*Attesting Officer*

NICHOLAS P. GODICI
*Acting Director of the United States Patent and Trademark Office*